United States Patent [19]

Scribner

[11] 4,095,733

[45] Jun. 20, 1978

[54] STOCK FEEDER FOR PUNCH PRESSES

[76] Inventor: Albert W. Scribner, 6 Country Club Rd., Darien, Conn. 06820

[21] Appl. No.: 800,284

[22] Filed: May 25, 1977

[51] Int. Cl.[2] ..... B65H 17/36

[52] U.S. Cl. ..... 226/162

[58] Field of Search ..... 226/147, 150, 162, 167

[56] References Cited

U.S. PATENT DOCUMENTS

| | | | |
|---|---|---|---|
| 3,038,645 | 6/1962 | Nordlof | 226/162 X |
| 3,157,334 | 11/1964 | Bunnell | 226/162 X |
| 3,326,438 | 6/1967 | Dickerman | 226/162 X |
| 3,462,056 | 8/1969 | Scribner | 226/162 X |
| 3,580,449 | 5/1971 | Chaban | 226/162 X |

*Primary Examiner*—Richard A. Schacher

[57] ABSTRACT

A pneumatic stock feeder for punch presses and the like, said feeder having an improved fluid actuating and control system. The feeder is provided with a stock gripping fluid motor means and a feed slide actuating fluid motor means; which fluid motor means are adapted to be controlled by an improved four-way slide valve arrangement. The slide valve includes a flat plate surface on which is disposed a recesses valve cup or pad that is laterally translatable between two operative valving positions. The recesses valve cup has a flat valving surface formed thereon that slidably engages said flat plate surface and valvingly cooperates with at least three ports formed in said flat plate surface so as to thereby control the operation of said fluid motor means. A control plunger and an associated coupling means are adapted to laterally shift said valve pad between its two operative positions in response to the movement of the ram of said punch press.

7 Claims, 7 Drawing Figures

Fig. 1
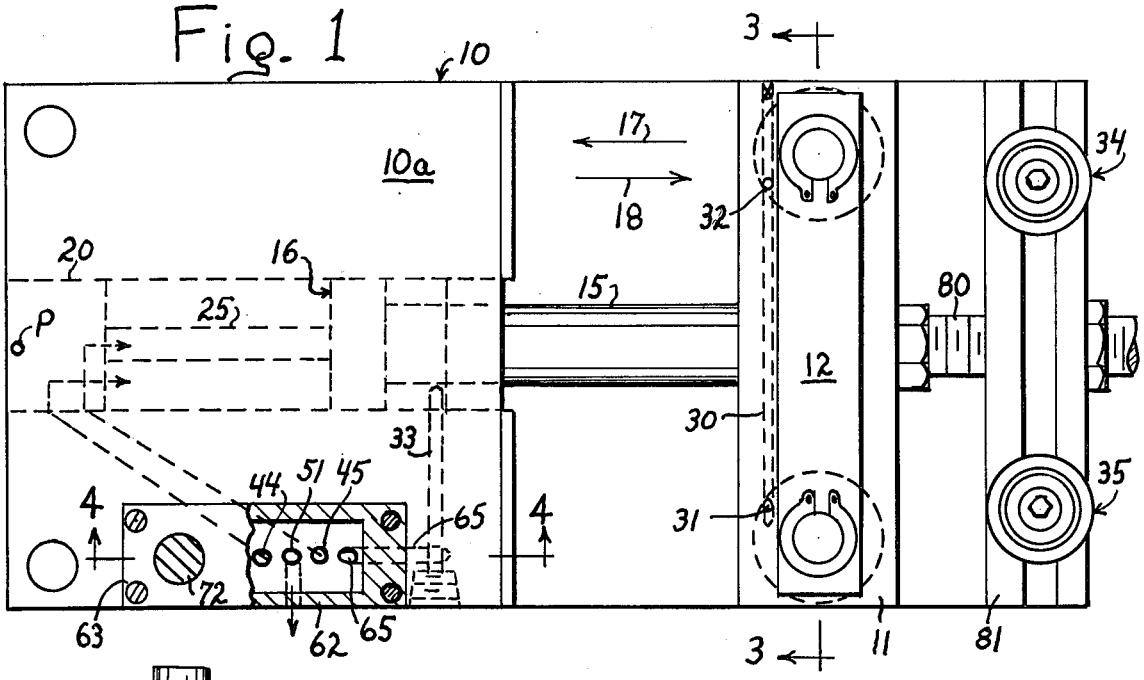
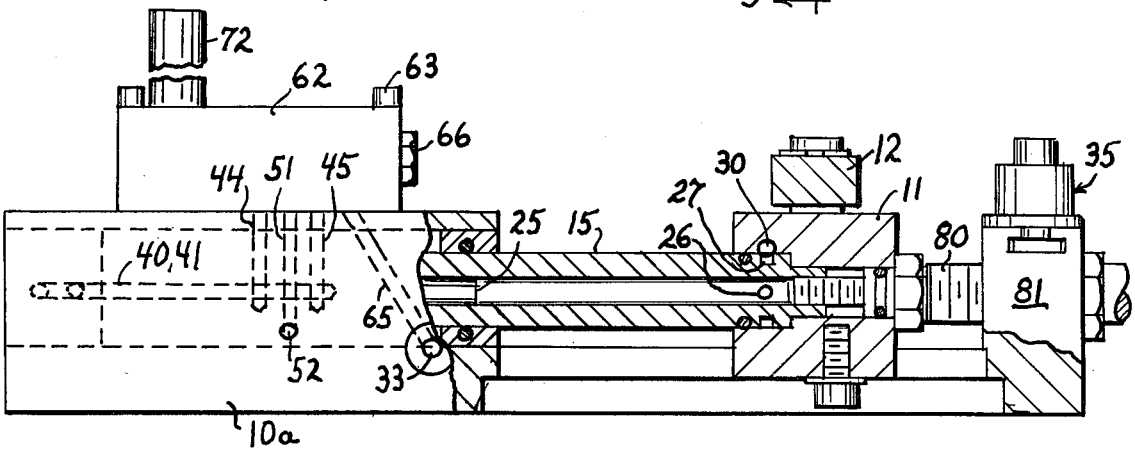
Fig. 2
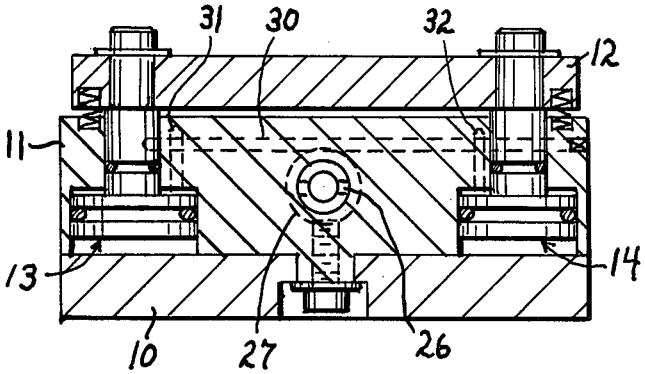
Fig. 3

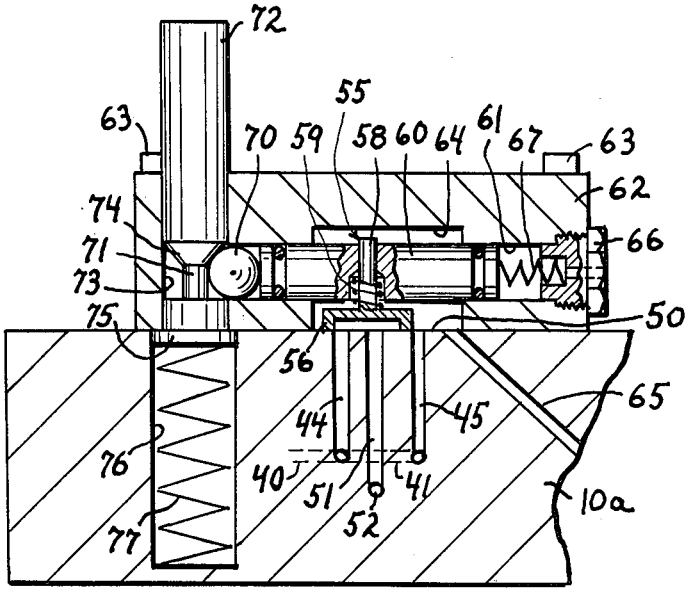
Fig. 4
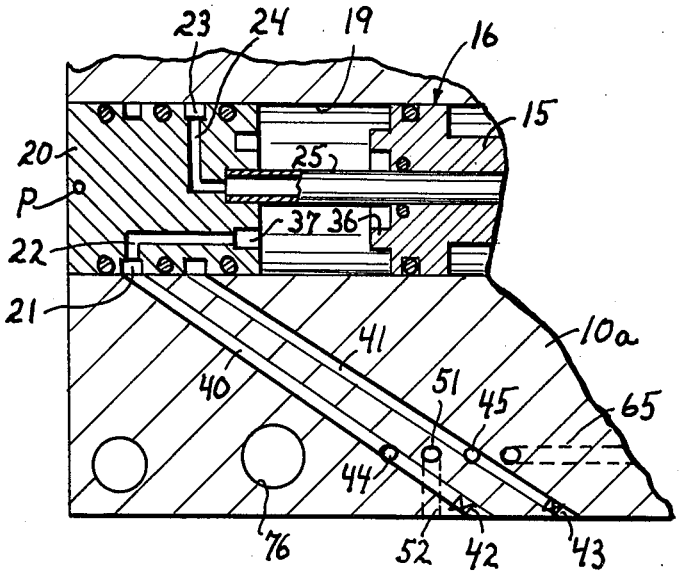
Fig. 5
Fig. 6
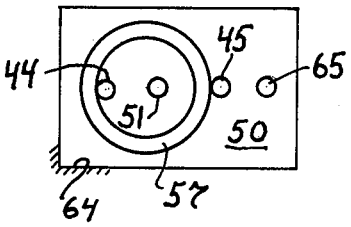
Fig. 7
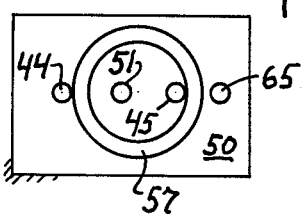

STOCK FEEDER FOR PUNCH PRESSES

BACKGROUND OF THE INVENTION

In earlier pneumatic punch press feeders of the general type illustrated in U.S. Pat. No. 3,329,327 either the fluid motors for the stock gripping means were double-acting rather than being of a simpler single-acting design, and/or the control valve arrangement required a plurality of individual valve units instead of a single unit. In other similar pneumatic feeders such as that shown in my copending application Ser. No. 679,490 filed May 10, 1976 external flexible tubing is required for servicing the fluid motors on the feed slide; such external tubing being subject to flexure failure and/or becoming disconnected while under operative fluid pressure. Thus these types of feeders while working satisfactorily require a certain amount of added cost or functional disadvantages by reason of the use of such double-acting fluid motors, multiple valve units, and/or external flexible tubing.

SUMMARY OF THE INVENTION

The present invention contemplates the provision of an improved fluid motor arrangement and a combined improved control valve system therefor whereby single-acting stock gripping fluid motors, a single four-way valve unit may be used, and no external flexible fluid conducting tubing is required.

The primary object of the invention is to provide a more efficient fluid motor and valve control combination for pneumatic punch press feeders.

Other objects of the invention will become apparent as the disclosure progresses.

In the drawings:

FIG. 1 is a plan view of the instant feeder with a part of the valve housing broken away.

FIG. 2 is a front elevational view taken in partial section along the longitudinal axis of the feeder.

FIG. 3 is a transverse sectional view taken along section line 3–3 of FIG. 1.

FIG. 4 is an elevational view taken along section line 4–4 of FIG. 1.

FIG. 5 is a partial sectional plan view taken in a horizontal plane through the axis of the main fluid motor.

FIGS. 6 and 7 are slightly enlarged diagrammatic sketches illustrating the two operative positions of the instant valve arrangement.

DETAILED DESCRIPTION OF THE INVENTION

The pneumatic feeder shown in the drawings includes an improved valving system for controlling the operation of the fluid motor arrangement of the instant feeder. The main frame, the feed slide and associated stock gripping means, and the fluid motor means may be similar to that shown and described in my copending application Ser. No. 792,720, filed May 2, 1977, and entitled "Semi-Automatic Stock Feeder", and reference may be had to that application for a detailed description of these above noted aspects of the feeder. For review purposes a short general description thereof will be made here. The one piece U-shaped main frame 10, FIG. 1, carries a reciprocable feed slide 11 that is provided with a stock gripping bar 12; the latter being actuated by a pair of single-acting fluid motors 13 and 14, FIG. 3, carried by the feed slide. The piston rod 15 of the main fluid motor 16 disposed in the body portion

10*a* of the main frame is connected to and is adapted to reciprocally actuate the feed slide 11 in feed and non-feed directions 17 and 18, FIG. 1, respectively. A plug 20, FIGS. 1 and 5, provided at the forward end of the main cylinder 19 is formed with a first circumferential groove 21, FIG. 5, and an associated and communicating passage 22 for conducting pressure fluid to and from the head end of the main cylinder 19, and is also formed with a second circumferential groove 23 and an associated and communicating passage 24 for conducting pressure fluid to and from said single-acting stock gripping motors 13 and 14 on the feed slide. The plug is secured in place by any suitable means such as a roll pin P, and suitable O-ring seals are provided on both sides of each of said circumverential grooves 21, 23. As is best seen in FIGS. 2 and 5 the fluid conduit means between said passage 24 and said gripper motors 13, 14 include a tube 25, the hollow piston rod 15, hole 26 and circumferential groove 27 at the end of piston rod 15, FIG. 2, and feed slide passages 30, 31 and 32. Pressure fluid is adapted to be continuously supplied to the rod end of the main cylinder 19 through a supply line 33, FIG. 1. The stock to be fed is adapted to pass between the laterally adjustable stock braking units 34, 35, FIG. 1 so as to be thereby continuously lightly braked; these braking units being similar to those shown and described in my said copending application Ser. No. 679,490 filed May 10, 1976. An annular projection 36, FIG. 5, on the face of the main piston cooperates with an adjacent annular groove 37 formed in the face of plug 20 so as to cooperatively afford a buffer or cushion action for the terminal portion of each feed stroke of the feeder.

The present invention contemplates the combination with the above described feeder transport apparatus of a novel and improved four-way valve control arrangement for controlling the main fluid motor 16 and the single-acting stock gripping motors 13 and 14. Referring primarily to FIGS. 4 and 5 the said circumferential plug grooves 21 and 23 communicate with separate horizontal fluid conducting lines 40 and 41, respectively, formed in the body portion 10*a* of the main frame; the outer ends of said lines being plugged as illustrated at 42 and 43 of FIG. 5. Lines 40 and 41 respectively communicate with vertical lines 44 and 45; the upper ends of the latter terminating at the smooth polished planar upper surface 50, FIG. 4, of the said body portion 10*a* of the main frame 10. Said body portion 10*a* is also formed with a vertical line 51, the upper end of which terminates at said planar surface 50 at a location between the upper ends of said lines 44 and 45 as is best seen in FIGS. 4, 6 and 7. The lower end of line 51 communicates with a horizontal exhaust line 52 that in turn communicates at its outer end with the surrounding air medium. As will be apparent the upper ends of said lines 44, 45 and 50 effectively define three valving ports in the flat surface 50.

A valving pad or cup member 55, FIG. 4, is provided for alternately covering and uncovering the two valving ports at the upper ends of lines 44 and 45, said member 55 including a lower cup or pad portion 56, FIG. 4, having a smooth polished planar annular bottom surface, as is diagrammatically illustrated by reference numeral 57 of FIGS. 6 and 7; said annular surface being adapted to slidably engage said smooth flat surface 50. The lower face of said disc or pad member 55 is formed with a central circular recess as illustrated in FIG. 4. Integrally connected to and extending upwardly from the said lower disc or pad portion 56 is a stem 58 that is disposed in a diametral hole formed through a horizontal slide bar 60 that is axially slidably mounted in a horizontal bore 61 formed in a valve housing body 62. The valve housing body is secured to the feeder frame by any suitable means such as screws 63. The reciprocable slide bar 60 is adapted to laterally displace the valve cup member 55 between two operative positions within a chamber 64, FIG. 4, formed in the valve housing body 62; the chamber 64 being adapted to be continuously supplied with pressure fluid from said supply line 33 through a suitable line 65 formed in said supply line 33 through a suitable line 65 formed in said body portion 10*a* of the main frame. The end portions of the slide bar 60 are provided with suitable O-ring sliding seals and the valve pad member 55 is biased against the said flat surface 50 by any suitable spring means such as that shown at 59 of FIG. 4, which spring in addition to the fluid pressure in chamber 64 serves to insure the continual sealed and sliding valving engagement of the lower annular surface of the valve pad or disc portion 56 with said flat surface 50. The right hand end of bore 61, as seen in FIG 4, is closed by a vented threaded plug 66, and a suitable spring 67 is provided to bias said slide bar to the left, as seen in FIG. 4, to a normal position determined by engagement of the left end of slide bar 60 with a ball 70 which in turn normally engages the reduced stem portion 71 of a control plunger 72 that is vertically reciprocally mounted in a suitable bore 73 formed in said valve housing body 62. Plunger 72 is formed with a conical surface 74 adjacent said stem portion 71 and with a lower flanged end 75; the latter being disposed in a vertical bore 76 formed in said body portion 10*a* of said main frame. A spring 77 disposed in bore 76 is adapted to bias plunger 72 to its normal upper or FIG. 4 position as determined by engagement of the flanged lower end 75 of the plunger with the adjacent lower surface of the valve housing body 62.

The said normal upper or FIG. 4 position of control plunger 72 thus determines the normal left hand FIG. 4 position of the slide bar 60 which in turn determines the first or normal operative position for the disc valve member 55 which is diagrammatically illustrated in FIG. 6. When the valve cup member 55 is in its said first or normal FIG. 6 position line 44 will communicate with exhaust line 51 through the recessed lower end of the valve cup portion 56 and line 45 will be simultaneously exposed to the continuously supplied pressure fluid in the valve chamber 64. Under these conditions the head end of the main cylinder 19 will be exhausted and the stock gripping fluid motors 13 and 14 will be supplied with pressure fluid whereby the feed slide 11 will partake of a feed stroke in the said feed direction 17, which stroke ends when the feed slide engages the adjacent end of the said body portion 10*a* of the main frame. When the control plunger 72 is displaced downwardly against the action of spring 77 in response to the downward movement of the punch press ram the conical surface 74 of the plunger will cam the ball 70 to the right, as seen in FIG. 4, so that the slide bar 60 and thus the valve cup member 55 are correspondingly displaced to the right whereby the valve cup member will be displaced to its second operative position which is diagrammatically illustrated in FIG. 7. In this second or FIG. 7 valving position the line 45 will now be coupled to the exhaust line 51 while the line 44 is simultaneously exposed to the continuously supplied pressure fluid in said valve chamber 64. Under these conditions then the head end of the main cylinder 19 will be supplied with pressure fluid while the stock gripping fluid motors 13 and 14 will be exhausted whereby the feed slide 11 will partake of a non-feed stroke in direction 18; which non-feed stroke will end when the feed slide 11 engages the usual stroke adjusting screw 80, FIG. 1, that threadedly engages the end block portion 81 of the main frame 10. Subsequently in response to the upward movement of the press ram spring 77 will urge the plunger 72 upwardly to its normal FIG. 4 position so that the slide spring 67 can then displace the slide bar 60 and valve cup member 55 back to their said normal FIG. 4 positions and, as previously described in connection with FIG. 6, the feed slide 11 will then partake of a feed stroke. It will thus be seen that the feeder may be cycled through non-feed and feed strokes in response to the downward and upward movements respectively of the control plunger 72.

The upper port end of line 44, as seen in FIGS. 1, 5–7, may have a slightly smaller diameter than that for line 45; the center of axis of such reduced port diameter being coincident with that of the line 44 shown in the drawings. This feature will aid in the operational timing of the feeder by assuring that the stock gripping motors are always operated before the main fluid motor initiates movement of the feed slide 11.

The above described improved and efficient slide valve arrangement and the shift linkage or coupling means 72, 70, 60 for said valve arrangement, in combination with fluid motor means and braking arrangement described, lends durability and reliability to the operation of the instant feeder.

I claim:

1. In a pneumatic feeder for advancing stock into the work station of a punch press or the like; said feeder including:

a frame;

a feed slide mounted on said frame for reciprocating movement through feed and non-feed strokes;

stock gripping means carried by said feed slide;

a first fluid motor means for actuating said feed slide;

a second fluid motor means for actuating said stock gripping means; and conduit means defining a pair of separate fluid conducting lines that are respectively connected to said first and second fluid motor means:

a slide valve for controlling the operation of said first and second fluid motor means; said slide valve including means defining a smooth plate surface, said surface having at least three ports formed therein, two of said ports being disposed respectively at the ends of said pair of fluid conducting lines and one of said ports effectively defining an exhaust port; a valve cup member having an end face defining a smooth valving surface, said end face of said cup member being recessed, said cup member being movable back and forth between two operative valving positions while said smooth plate and valve cup surfaces are in mutual sliding engagement;

conduit means adapted to continuously supply pressure fluid to a chamber formed in said slide valve so as to bias said valve cup member against said plate surface whereby when said valve cup member is in a first one of its said two operative positions one of said two fluid conducting lines is exposed to the pressure fluid in said valve chamber while the other of said fluid conducting lines is connected through said recessed end face of said valve cup member to said exhaust port, and vice versa when said valve cup member is shifted to the second one of its said two operative positions;

a control plunger adapted to be operated in response to the operation of said punch press; and coupling means adapted to effectively couple said control plunger and said valve cup member whereby said valve cup member may be shifted between its said two operative positions in response to the movement of said control plunger.

2. Apparatus as defined by claim 1 wherein said coupling means includes a biasing means for urging said valve cup member towards one of its operative conditions and a cam means adapted to displace said valve cup member to its other operative position in response to the movement of said plunger.

3. Apparatus as defined by claim 1 wherein said two of said ports in aid plate surface have different effective sizes whereby said first fluid motor means is actuated after actuation of said second fluid motor means.

4. Apparatus as defined by claim 1 wherein said first fluid motor means includes a double-acting fluid motor having one end thereof that is adapted to be continuously supplied with pressure fluid; wherein said second fluid motor means includes a single acting fluid motor means, and wherein said valve cup member is lightly biased by a spring means so that its said valving surface is normally urged into engagement with said plate surface.

5. Apparatus as defined by claim 1 wherein said valve cup member when in its normal operative position is adapted to couple the head end of said first fluid motor means to said exhaust port and to simultaneously couple said second fluid motor means to said pressure fluid in said valve chamber.

6. Apparatus as defined by claim 1 wherein said plate surface is flat, wherein said valving surface on said valve cup member is also flat, and wherein said valve cup member is adapted to be bodily translated laterally back and forth between its said two operative positions.

7. Apparatus as defined by claim 6 wherein the direction of movement of said valve cup member is at an angle with respect to the direction of movement of said control plunger.

* * * * *